US005216395A

United States Patent [19]

Babbitt et al.

[11] Patent Number: 5,216,395

[45] Date of Patent: Jun. 1, 1993

[54] QUARTER WAVE HIGH VOLTAGE DC BLOCK COVERED WITH A POLYURETHANE INSULATING LAYER

[75] Inventors: Richard W. Babbitt, Fair Haven; William C. Drach, Trenton; Thomas E. Koscica, Clark, all of N.J.

[73] Assignee: The United States of America as represented by the Secretary of the Army, Washington, D.C.

[21] Appl. No.: 892,837

[22] Filed: Jun. 3, 1992

[51] Int. Cl.[5] ..... H01P 1/20

[52] U.S. Cl. ..... 333/246; 361/540

[58] Field of Search ..... 333/116, 204, 246; 361/311, 313, 323, 540

[56] References Cited

U.S. PATENT DOCUMENTS 3,783,480 1/1974 Booe ..... 361/323 X
3,851,363 12/1974 Booe ..... 361/323 X
5,008,639 4/1991 Pavio ..... 333/116

OTHER PUBLICATIONS

Koscica, *High Voltage Microwave DC Block for Microstrip Ground Planes*, Electronics Letters, Aug. 2, 1990, vol. 26, No. 16, pp. 1287–1288.

Borgaon Kar et al., *Analysis and Design of D.C. Blocks*, Electronics Letters, Jan. 22, 1981, vol. 17, No. 2, pp. 101–103.

Koscica, *Wide-band Ground Plane DC Block and Bias Feed*, IEEE Trans. on MTT, vol. 38, No. 6, Jun. 1990, pp. 805–806.

*Primary Examiner*—Paul Gensler

*Attorney, Agent, or Firm*—Michael Zelenka; Raymond M. Saunders; William H. Anderson

[57] ABSTRACT

A DC high voltage block comprising coupled lines etched upon a substrate and covered with a bubble-free, polyurethane insulating layer. The polyurethane insulating layer prevents DC voltage breakdown through air. This DC voltage block provides a planar, noncomplex circuit that can effectively provide voltage blockage up to 4500 volts. High voltage DC blocks of this nature have applications in vacuum tubes and IMPATT devices, as well as ferro-electric or electro-optic phase shifters. They are also employed to protect bias tees and electrical devices that employ bias tees.

1 Claim, 2 Drawing Sheets

QUARTER WAVE HIGH VOLTAGE DC BLOCK COVERED WITH A POLYURETHANE INSULATING LAYER

GOVERNMENT INTEREST

The invention described herein may be manufactured, used, and licensed by or for the Government of the United States of America for governmental purposes without the payment to us of any royalty thereon.

BACKGROUND OF THE INVENTION

1. Field of the Invention

The invention relates to radars, communications systems, and other electrical applications that employ microwave circuits in conjunction with high voltage DC blocks. High voltage DC blocks of this nature have applications in vacuum tubes and IMPATT devices, as well as ferro-electric or electrooptic phase shifters. They are also employed to protect bias tees and electrical devices that employ bias tees.

2. Description of the Prior Art

An inexpensive, compact, easily manufacturable high voltage DC block within devices employing microwave circuits is needed to allow the use of higher voltages in coupled line filters than previously possible. Conventional DC voltage blocks are effective up to approximately 200 volts. The DC voltage block of the instant invention is effective up to at least 4500 volts. DC voltage blocks in conventional microcircuits consist of coupled line filters as discussed in D. Lacombe and J. Cohen, "Octave-band microstrip DC blocks," *IEEE Trans. Microwave Theory Tech.*, vol. MTT-20, pp. 555–556, Aug. 1972; B.A. Syrett, "A broad-band element for microstrip bias or tuning circuits,"*IEEE Trans. Microwave Theory Tech.*, vol. MTT-28, pp. 925–927, Aug. 1980; S.R. Borgaonkar and S.N. Rao, "Analysis and design of D.C. blocks," Electronics Lett., vol. 17, pp. 101–103, Jan. 1981; B.J. Minnis, "Printed circuit coupled-line filters for bandwidths up to and greater than an octave," *IEEE Trans. Microwave Theory Tech.*, vol. MTT-29, pp. 215–222, Mar. 1981. It has been recognized previously that the use of overlays superimposed upon coupled lines is a technique for ameliorating voltage breakdown. J. L. Klein and K. Chang, "Optimum dielectric overlay thickness for equal even- and odd-mode, phase velocities in coupled microstrip circuits," Electronics Lett., pp. 274–276, Mar. 1990. Standard coupled line filters perform well up to 200 voltages, but with higher voltages they are subject to voltage breakdown. A ground plane DC block was described in T.E. Koscica, "Wide-band ground-plane DC block and bias feed;" *IEEE Trans. Microwave Theory Tech.*, vol. MTT-*38*, pp. *805–806*, June 1990. Thius DC block was further improved and described in T.E. Koscica, "High Voltage Microwave DL Block for Microstrip Ground Planes, " *Electronics Lett., vol.* 26, pp. 1287–1288 August 1990 which withstands voltages as high as 4 kilovolts. In the Koscica article, a DC block was described which was coated with silicone rubber to reduce voltage breakdown through the air. This ground plane DC block was limited by three factors. First, voltage breakdown is a function of the gap length across which voltage is applied. Any processing flaws along the gap length of ground plane DC block results in reduced voltage breakdown protection. Second, it is not amenable to modeling techniques, but is instead dependent upon empirical data. And third, silicone rubber contains acid which acts as an oxidizing agent to copper.

SUMMARY OF THE INVENTION

The first general purpose of this invention is to provide a novel high voltage DC block that permits the use of higher voltages than heretofore possible. The high voltage DC block of this invention is based upon a quarter wave coupled line DC block which has an additional layer of polyurethane to provide voltage breakdown protection across the gap. The polyurethane layer acts to prevent voltage breakdown across the gap of the DC block, but unlike silicone rubber, the polyurethane layer does not act as an oxidizing agent to copper.

A second objective of the present invention is to allow mathematical modeling of the critical variables of the high voltage DC block. Further objectives include reducing component sizes in DC blocks, allowing single-side fabrication, and increasing performance stability.

A still further object of the present invention is to provide a method for fabricating the novel high voltage DC block.

BRIEF DESCRIPTION OF THE DRAWINGS

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
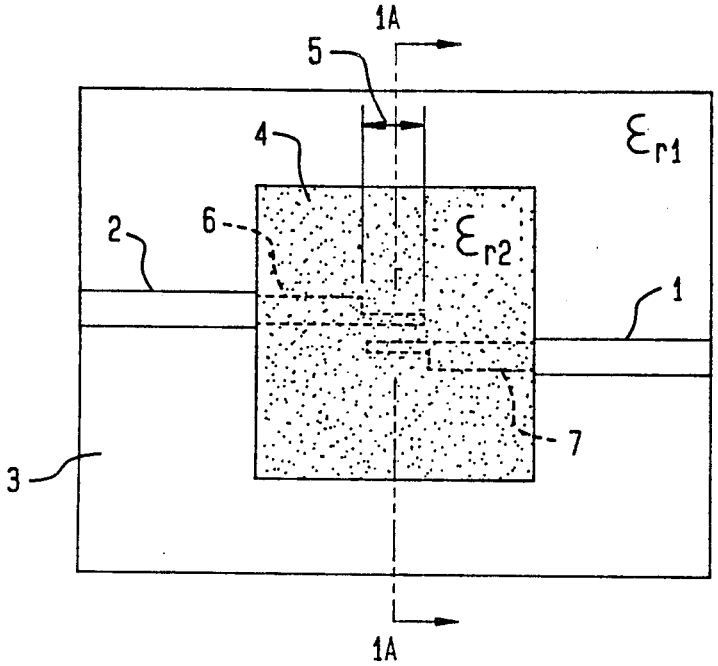
FIG. 1 is a top schematic view of the invention.
Figure 2:
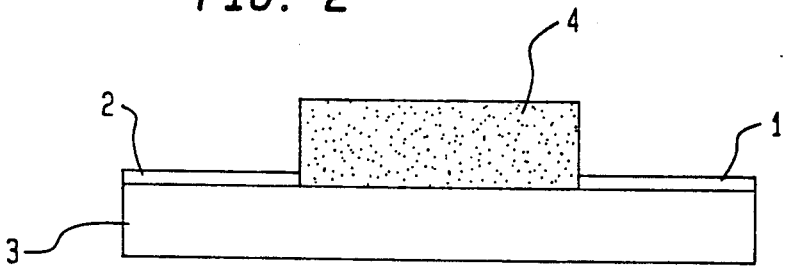
FIG. 2 is a side schematic view of the invention.

Referring now to the drawings there is shown in FIG. 1 a top schematic view of the invention. Coupled line (1) and coupled line (2) are deposited on a substrate (3) in combination with an insulating dielectric layer composed of polyurethane base (4), deposited over the coupled lines. Coupled line (1) and coupled line (2) are quarter-wave coupled lines. Coupled lines are most often employed as pass band filters, but in this invention they are employed in a DC voltage block application. In order to achieve a good bandwidth and standing wave ratio (SWR), the gap separation (s) between coupled line (1) and coupled line (2) must be adjusted. In addition, the width (w) of coupled line (1) and coupled line (2) must be adjusted. By reference to the effective dielectric constant, the length of the coupled line region (5) can be adjusted to arrive at the required center frequency.

The polyurethane insulating layer affects the even and odd mode impedances of the coupled lines (1, 2). The polyurethane is applied to both the coupled line region (5) of coupled line (1) and coupled line (2) and to the area of each coupled line immediately adjacent (6, 7) to the coupled region (5). This region is insulated to ensure that the coupled region (5) has an adequate guard region around it.

Figure 3:
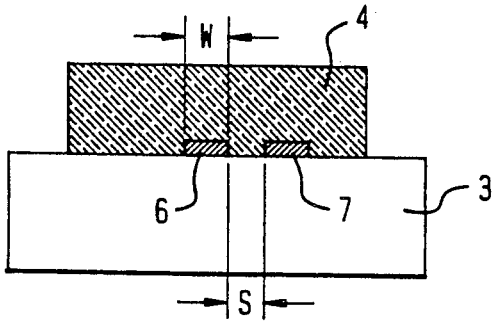
FIG. 3 is a pictorial cross along line 1A—1A.

In order to determine the optimal physical parameters of the coupled lines (1, 2), it is first necessary to determine the effective dielectric constant of the area beneath the insulating layer (4). This value is determined by employing the variational technique on combination with the transverse transmission line method as described in B. Bhat and S. K. Koul, "Unified Approach to solve a class of strip and micro-strip like transmission lines," *IEEE Trans. Microwave Theory and Techniques, rst. MTT-5 pp.* 679–686, May 1982. This method generates the value for C, the capacitance per unit length with the substrate and dielectric juxtapositioned as shown in FIG. 3. It also generates the value for $C_{air}$, capacitance per unit length for both dielectrics replaced by air. The effective dielectric constant for the microstrip can then be determined as follows:

$$\epsilon_{eff} = \frac{C\epsilon_r}{C_{air}}$$

Figure 5:
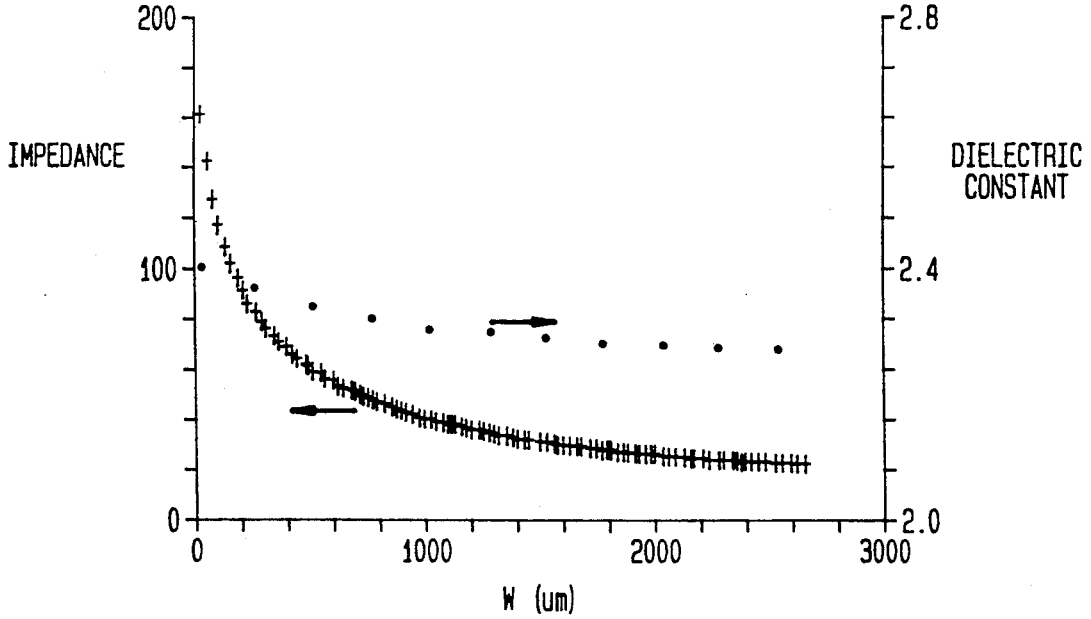
FIG. 5 is a graph depicting the dielectric constant of the insulated substrate as a function of coupled line width (w) and impedance.

The dielectric constant for various metalization widths is shown in the chart at FIG. 5.

Once $\epsilon_{eff}$ is determined, the impedance for the overlay microstrip can be determined by using the following expression set forth in J. L. Klein and K. Chang, "Optimum dielectric overlay thickness for equal even- and odd-mode phase velocities in coupled microstrip circuits," *Electron Lett.*, pp. 274–276, Mar. 1990:

$$Z = l/C_o E_{eff}^{-2} C_{air}$$

where the value used for $C_{air}$ is obtained using the standard microstrip equations found in J. J. Lev, "Synthesize and analyze microstrip lines," *Microwaves and RF,*" pp. 111–116, Jan. 1985; and M. Kirsching and R. H. Jansen, "Accurate model for effective dielectric constant of microstrip with validity up to millimeter-wave frequencies," *Elect. Lett.*, pp. 25–26, Feb. 1982, using $\epsilon_r = 1$. Once the required SWR and bandwidth are determined, the relationships for determining $Z_{oe}$ and $Z_{oo}$, the even and odd mode impedance values respectively, can be determined by referring to D. Kajfez and B. S. Vidula, "Design equations for symmetric DC blocks," *IEEE Trans. Microwave Theory Tech.*, vol. MTT-28, pp. 974–981, 1980. These relationships are as follows:

$$Z_{oe} = \sqrt{s}\left[1 + \sqrt{1 + \frac{1 + \sqrt{1 + Q_c^2}}{Q_c^2}\left(1 - \frac{1}{s}\right)}\right]$$

$$Z_{oo} = \sqrt{s}\left[-1 + \sqrt{1 + \frac{1 + \sqrt{1 + Q_c^2}}{Q_c^2}\left(1 - \frac{1}{s}\right)}\right]$$

Where S is the standing wave ratio and Q is a normalized bandwidth as described by in "Design equations for symmetric DC blocks," above.

To relate the even and odd mode impedances to physical dimensions, the variational technique combined with the transverse transmission line method as discussed in "Unified Approach to solve a class of strip and micro-strip like transmission lines," above, is used to obtain the values of $C\epsilon_{r(even)}$ and $C\epsilon_{r(odd)}$, the even and odd mode capacitance per unit length with the substrate and dielectric juxapositioned as shown in FIG. 3. The same method is used to determine $C_{air(odd)}$ and $C_{air(even)}$, capacitance per unit length with all dielectric replaced by air. The effective dielectric constant for the coupled lines (1,2) then are as follows:

$$\epsilon_{eff(even)} = \frac{C\epsilon_{r(even)}}{C_{air(even)}}$$

$$\epsilon_{eff(odd)} = \frac{C\epsilon_{r(odd)}}{C_{air(even)}}$$

The impedance of the patterned coupled line portion of the dielectric microstrip can be derived from the following expressions found in "Optimum Dielectric Overlay Thickness for Equal Even- and Odd-Mode Phase Velocities in Coupled Microstrip Circuits," above.

$$Z_{oe} = \frac{1}{C_o\sqrt{\epsilon_{eff(even)}}\, C_{air(even)}}$$

$$Z_{oo} = \frac{1}{C_o\sqrt{\epsilon_{eff(odd)}}\, C_{air(odd)}}$$

The effective dielectric constant for the coupled lines becomes:

$$\epsilon_{eff} = \sqrt{\epsilon_{eff(even)}\, \epsilon_{eff(odd)}}$$

Figure 4:
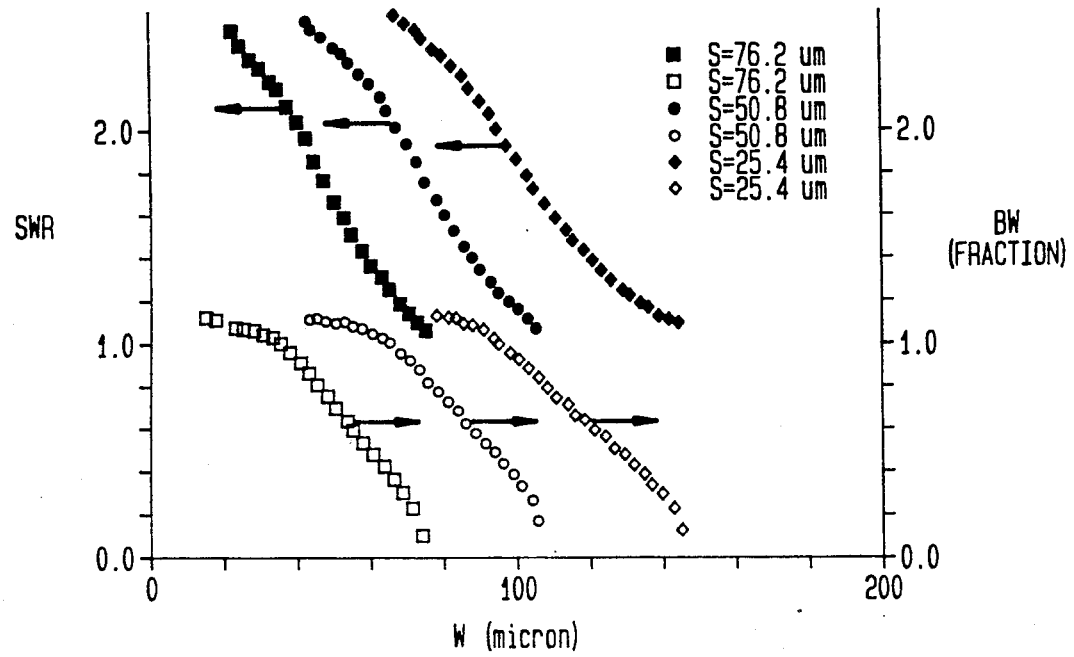
FIG. 4 is a graph depicting Standing Wave Ratio (SWR) and bandwidth (BW) as functions of gap width, s, and the coupled line width, w.

Calculations based on this relationship result in obtaining SWR and bandwidth as functions of gap width, s, and the coupled line width, w. Results are presented in FIG. 4. Several circuits were constructed which resulted in SWR and bandwidth values only slightly less than predicted. Reasons for this error include the fact that the actual circuits had coupled lines of finite thickness.

The length of the coupled lines is slightly less than $\lambda g/4$ where $\lambda g$ is $\lambda o/\epsilon_{eff}$ and $\lambda o$ is the wavelength in air at the center of the passband. The slight reduction is due to end effects. This slight reduction, however, results in degraded performance. The wider the gap width, the greater the voltage breakdown protection available. Increased gap width, however, results in poorer SWR and bandwidth characteristics. A Duroid substrate with a Teflon-based circuit with s=50 um and w=60 um gave a voltage breakdown of over 4500 volts. The particular Teflon-based circuit used was a substrate composed of Duroid, manufactured by the Rogers Company, with a thickness of 254 microns. Other based Teflon-based substrates, however, would be suitable.

A matter of critical importance to the proper functioning of the DC voltage block is that the polyurethane insulating layer be applied to the substrate in a manner that eliminates air bubbles from the region adjacent to the interface between the microstrip circuit and the polyurethane insulating layer. This can be accomplished by applying the polyurethane insulating layer in a vacuum. The polyurethane insulating layer insulating layer is allowed to dry for approximately 24 hours before the invention is used.

Another important consideration is that the surface of the substrate and the etched transmission lines thereon be cleaned prior to application of the polyurethane insulating layer. This cleaning can be accomplished with a cleaning agent like Nutraclean. A clean, dry surface provides maximum protection against voltage breakdown.

It is to be understood that other features are unique and that various modifications are contemplated and may obviously be resorted to by those skilled in the art. Specifically, the invention contemplates various substrates, insulating coatings, frequencies, and multi-coupled line filters. Therefore, within the scope of the appended claims, the invention may be practiced otherwise than a specifically described.

What is claimed is:

1. A DC volt block comprising:

a dielectric substrate;

at least first and second conductive microstrip lines deposited on said substrate such that said first and second microstrip lines are separated to form quarter wave coupled lines, said first and second microstrip lines being separated by a predetermined gap distance and having predetermined widths; and a polyurethane layer vacuum deposited over said first and second microstrip lines and said dielectric substrate such that said polyurethane layer covers a sufficient area to prevent any DC voltage breakdown passing across said gap distance between said microstrip lines.

* * * * *